US005755401A

United States Patent [19]

Frey et al.

[11] Patent Number: 5,755,401

[45] Date of Patent: May 26, 1998

[54] MISSILE DIVERTER INTEGRATION METHOD AND SYSTEM

[75] Inventors: Thomas J. Frey, Wilmington, Del.; Philip H. Dara, North East, Md.; Michael A. Gerace, Phoenix, Ariz.; Mark A. Solberg, Bel Air, Md.

[73] Assignee: Thiokol Corporation, Ogden, Utah

[21] Appl. No.: 551,006

[22] Filed: Oct. 31, 1995

[51] Int. Cl.[6] ..... F42B 10/60

[52] U.S. Cl. ..... 244/3.22; 137/375; 137/883; 60/254

[58] Field of Search ..... 244/3.22; 102/376, 102/374, 381; 60/253, 254; 137/375, 883

[56] References Cited

U.S. PATENT DOCUMENTS

| | | | |
|---|---|---|---|
| 4,081,891 | 4/1978 | Morrison | 29/157.1 R |
| 4,242,080 | 12/1980 | Morrison | 251/315 |
| 4,489,657 | 12/1984 | Langer | 102/290 |
| 4,541,592 | 9/1985 | Moll | 244/3.22 |
| 4,711,086 | 12/1987 | Offe et al. | 60/253 |
| 4,712,747 | 12/1987 | Metz et al. | 244/3.22 |
| 4,726,544 | 2/1988 | Unterstein | 244/3.22 |
| 4,733,696 | 3/1988 | Baun | 137/883 |
| 4,847,396 | 7/1989 | Beers et al. | 556/421 |
| 4,979,697 | 12/1990 | Kranz | 244/3.22 |
| 5,062,593 | 11/1991 | Goddard et al. | 244/169 |
| 5,132,182 | 7/1992 | Grosse-Puppendahl et al. | 428/475.8 |
| 5,158,246 | 10/1992 | Anderson, Jr. | 244/3.22 |
| 5,223,584 | 6/1993 | Lenke et al. | 525/405 |
| 5,405,103 | 4/1995 | Girardeau et al. | 244/3.22 |
| 5,456,425 | 10/1995 | Morris et al. | 244/3.22 |
| 5,472,053 | 12/1995 | Sullaway et al. | 166/327 |
| 5,474,758 | 12/1995 | Kwon | 424/45 |
| 5,570,573 | 11/1996 | Bonnelie | 60/253 |
| 5,579,635 | 12/1996 | Miskelly, Jr. et al. | 60/242 |
| 5,579,636 | 12/1996 | Rosenfield | 60/251 |

FOREIGN PATENT DOCUMENTS

| | | | |
|---|---|---|---|
| 255776 | 2/1988 | European Pat. Off. | 244/3.22 |

*Primary Examiner*—Michael J. Carone
*Assistant Examiner*—Christopher K. Montgomery
*Attorney, Agent, or Firm*—Cushman Darby & Cushman IP Group of Pillsbury Madison & Sutro, LLP; Ronald L. Lyons, Esq.

[57] ABSTRACT

A missile diverter for controlling yaw and pitch includes several valve housings secured to an inside surface of a bridge or to a removable cylinder. The valve housings are secured in aligned positions by a layer of integral cured insulation. Gas valves are placed in the housings, and control lines are connected to the valves to allow remote control of the valves during flight. Cups loaded with propellant are secured in place near the valve housings. The valve housings, valves, cured insulation, and propellant cups are then overwrapped and secured within the outer shell of a missile. One method for making the missile diverter includes the step of applying a quantity of uncured insulation to an inside surface of a bridge and to an outside surface of each valve housing. Each valve housing is then positioned within the bridge and the insulation is cured to form an integral layer that holds the valve housings in their aligned positions and forms a hot gas seal.

39 Claims, 6 Drawing Sheets

MISSILE DIVERTER INTEGRATION METHOD AND SYSTEM

FIELD OF THE INVENTION

The present invention relates to diverters which control the pitch and yaw of missiles, and more particularly to a method and system for integrating gas valves into a diverter by forming an integral layer of vulcanized insulation which secures the gas valves in position within a gas generator case.

TECHNICAL BACKGROUND OF THE INVENTION

A missile typically includes a cylindrical shell having a central longitudinal axis. The missile is configured to expel combustion products along a vector parallel to the central axis, thereby providing axial thrust which propels the missile forward. Many missiles are also equipped with some type of diverter to provide control over the missile's yaw and pitch. The diverter selectively emits combustion products along one or more vectors transverse to the missile's central axis, thereby selectively altering the missile's yaw and/or pitch during flight.

One conventional diverter includes several pipes which provide fluid communication between a gas generator and several ports. The ports are typically spaced apart from one another about the perimeter of a cylindrical section of the missile shell. The pipes are secured in place between the missile shell and the exterior of the gas generator by braces or struts. A first section of each pipe near the gas generator is generally parallel to the central axis of the missile. The next section of each pipe curves away from the center axis outwardly toward the missile shell, and the final section leads to one of the ports in the shell. Thus, a four-pipe diverter defines an X-shape when viewed along the central axis of the missile. A valve attached to each pipe controls fluid flow through the pipe, thereby allowing selective emission of combustion products through the corresponding port to alter the missile's yaw, pitch, or both during flight.

Unfortunately, such diverters have several drawbacks. The pipes must provide a reliable conduit for carrying hot gas and other combustion products without leakage. The materials required to form reliable pipes and reliable seals around the pipes are expensive to manufacture and use. Moreover, both the pipes and the braces that secure the pipes add weight to the missile, thereby reducing the effective payload for a given propellant charge. It is also extremely difficult to produce a combination of pipes and braces which remain properly aligned during flight. Even a small change in the position of a pipe relative to the missile can introduce errors into the yaw and pitch control provided by diverting gases through the pipe, thereby driving the missile off course.

Known diverters are also difficult and expensive to produce. Diverters are typically manufactured in two phases. During the first phase, a gas generator is formed by securing a propellant charge to an insulator within a gas generator case. In particular, the gas generator case is formed and then the insulator is positioned within the case and vulcanized or otherwise cured. A propellant slurry is placed in the interior of the chamber defined by the insulator and cured to form the propellant charge. Alternatively, the gas generator case may be filament-wound over a layer of previously cured insulation which contains a solid propellant grain. The wound case is then cured. Under either approach, the insulation is cured before the pipes are attached.

During the second phase of diverter manufacture, hot gas pipes with attached valves are mechanically secured in place. One end of each pipe is connected to the exterior of the gas generator and the other end of each pipe is connected to the missile shell. Braces are secured to the pipes and the missile shell to hold the pipes in position relative to the shell. Great care must be taken to align, secure, and seal the pipes so that combustion products travel only through the pipes from the gas generator and leave the diverter along the expected vector during flight.

Thus, it would be an advancement in the art to provide a missile diverter in which the components used to direct the flow of combustion products are easier to reliably align than the pipes used in conventional diverters.

It would also be an advancement to provide such a diverter which is lighter than conventional diverters.

It would be a further advancement to provide methods for manufacturing such a diverter.

Such a diverter and methods of manufacturing are disclosed and claimed herein.

BRIEF SUMMARY OF THE INVENTION

The present invention provides a missile diverter for controlling yaw and pitch by selectively directing combustion products of a gas generator away from a missile at an angle to a central longitudinal axis of the missile. In one embodiment, the present invention includes a missile diverter having several valve housings secured to an inside surface of a cylindrical bridge within a gas generator case. The housings are secured by a layer of integral cured insulation which also provides a hot gas seal between the bridge and the valves. The present invention also provides methods for manufacturing such a diverter.

The bridge and the gas generator case are formed of metal and/or composite materials by techniques well-known in the art. Each is substantially cylindrical, with a central longitudinal axis that parallels the central longitudinal axis of the missile. A primary cup loaded with propellant is secured within the bridge adjacent the valve housings. A secondary cup loaded with propellant is also secured in the bridge adjacent the valve housings. A removable barrier separates the secondary cup's propellant from the valve housings.

The valve housing houses a hot gas valve of a type familiar to those of skill in the art, such as a remotely actuatable solenoid valve. The number and placement of valve housings may vary. One embodiment includes four valve housings positioned generally equidistant from one another in a plane perpendicular to the central axis of the gas generator case.

The present invention also provides methods for making missile diverters generally, and methods for integrating gas valves into a diverter's gas generator in particular. One method includes the step of applying a quantity of uncured insulation to an inside surface of the cylindrical bridge. The uncured insulation may contain rubber, composites, or other materials. Another quantity of uncured insulation is applied to an outside surface of each several valve housings.

Each of the valve housings is then positioned within the bridge in a predetermined desired position. One method places the valve housings equidistant from one another in a plane perpendicular to the central axis of the bridge. Four valve housings are positioned ninety degrees apart from one another in a ring about the central axis of the bridge.

Proper positioning of the valve housings is readily accomplished because the valve housings rest directly against the interior wall of the bridge. By contrast, the pipes used in conventional diverters are held in position by braces which are subject to increasing misalignment during flight. The valve housings may be mechanically attached to the bridge. Unlike the pipes of conventional diverters, however, the valve housings of the present invention do not rely solely or primarily on mechanical attachments to maintain their proper alignment during flight. Instead, the valve housings are secured by a layer of integral cured insulation which also provides a hot gas seal between the bridge and the valves.

The quantities of insulation on the bridge and the valve housings are bonded together by curing the rubber or other binder in the insulation, thereby creating an integral layer of cured insulation. Proper techniques for vulcanizing rubber insulation and for curing composite insulation are readily determined by those of skill in the art.

Each valve housing holds a separately controllable diverter gas valve. The gas valves may be secured in their housings after the insulation is cured or at an earlier point in the process. After the gas valves and their housings are in place, wires or other control lines are connected to the valves and secured to the bridge or gas generator case in a manner that does not breach the gas seal provided by the insulation layer. The control lines support remote actuation of the valves during flight. The control lines may allow each diverter gas valve to be actuated independently of the other gas valves, or they may actuate two or more selected valves in tandem.

One method of the present invention applies uncured insulation to an inside surface of a cylindrical removable tooling device instead of applying it to the inside surface of the bridge. Next, the valve housings are positioned within the tooling device. The insulation is then cured to secure the housings in place and provide a hot gas seal that prevents gas from escaping around the exterior of the valves. The tooling device is removed from the cured insulation, and the cured insulation and the valve housings are secured within the gas generator case.

Methods of the present invention also include the step of loading solid fuel propellant into the gas generator adjacent the valve housings. This may be accomplished by loading one or more cups which carry propellant. The cups are placed adjacent the valve housings such that combustion products will travel through a selected housing and away from the missile after the propellant in the cup is ignited. Removable barriers, such as burst diaphragms, may be placed between one or more of the loaded propellant cups to allow staged ignition of the propellant in different cups.

The gas generator case is then formed around the propellant cups and the bridge by tape lay-up, fiber winding, or a similar process. The case is cured by a room-temperature curing method such as exposure to ultraviolet or microwave radiation. The entire diverter assembly is then secured within a missile shell.

The features and advantages of the present invention will become more fully apparent through the following description and appended claims taken in conjunction with the accompanying drawings.

BRIEF DESCRIPTION OF THE DRAWINGS

To illustrate the manner in which the advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
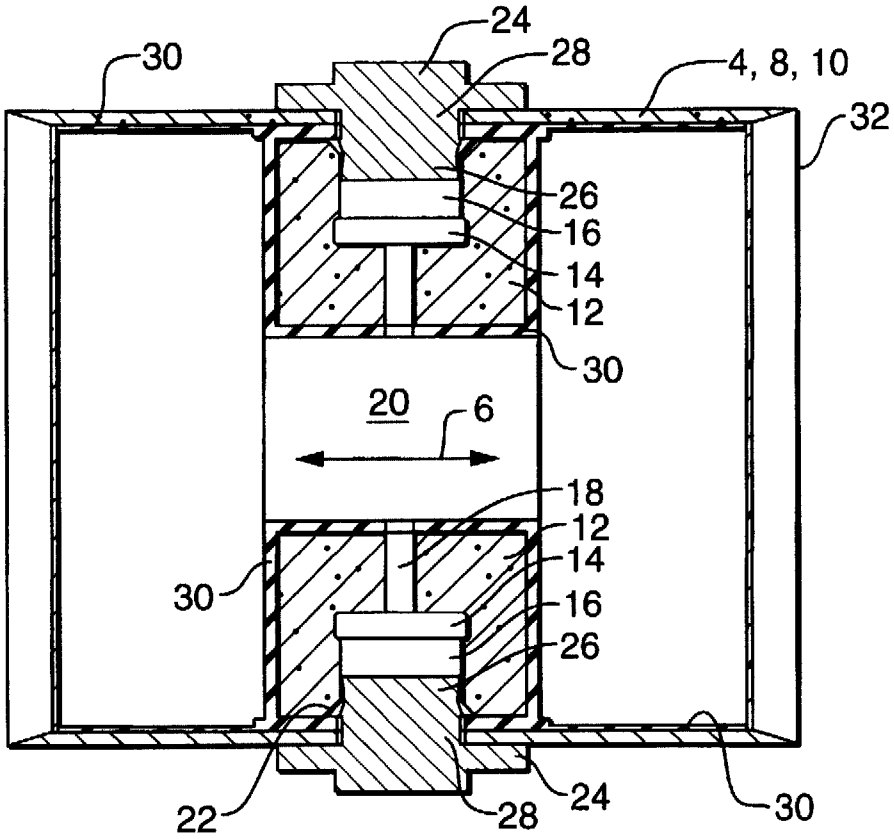
FIG. 1 is a longitudinal cross-section illustrating valve housings positioned within an insulation support by an alignment tool according to the present invention.

Reference is now made to the figures wherein like parts are referred to by like numerals. The present invention relates to a method and system for securing gas valves within a gas generator case and providing a hot gas seal about the valves. One embodiment of the system of the present invention includes an insulation support 4 having a central longitudinal axis 6, as illustrated in FIG. 1. According to the present invention, the insulation support 4 may include either a removable tooling device 8 or a bridge 10. Although a cylindrical insulation support 4 is illustrated, insulation supports in alternative embodiments have spherical, elliptical, and other shapes.

Suitable materials for use in the bridge 10 include metals such as steel and aluminum; composites such as carbon, glass, or aramid fibers embedded in a thermoset or ambient-cured resin; and other materials suitable for use in gas generators or pressure vessels. Ambient-cured resins include resins cured by ultraviolet radiation, resins cured by microwave radiation, room-temperature-cure epoxies, and other resins capable of being cured at ambient temperature. Composite embodiments of the bridge 10 are formed by fiber winding, filament winding, tape lay-up, and other techniques familiar to those of skill in the art.

A valve housing 12 and a valve 14 are positioned within the bridge 10. Although the valve housing 12 illustrated is configured to house one valve 14, in alternative embodiments the valve housing is configured to house a plurality of valves. Each valve 14 illustrated can be actuated at least once to control fluid flow for controlling a missile during flight.

Although particular valves 14 are discussed herein, a variety of valves may be employed in embodiments of the present invention. Suitable valves include remotely actuatable solenoid valves capable of repeated operation, burst-disk valves capable of opening but not of closing after being opened, and other gas valves familiar to those of skill in the art. The present invention may also be used to secure housings which define throats, venturis, or other means for controlling the flow of gas out of a gas generator.

With continued reference to FIG. 1, the valve housing 12 defines a valve chamber 16 in which the valve 14 is secured. The valve housing 12 also defines a valve bore 18 having a chamfer 22. The bore 18 provides fluid communication between the valve chamber 16 of the valve housing 12 and a case chamber 20. As shown, the case chamber 20 is substantially defined by the bridge 10 and the valve housings 12.

Suitable valve housings are readily determined by those of skill in the art. The shape and/or relative size of the valve chamber 16, the valve bore 18, and/or the case chamber 20 can be varied in alternative embodiments to provide the desired diversion thrust during a particular missile's flight. In alternative embodiments the valve occupies substantially the entire valve chamber, substantially the entire valve bore, or both. In addition, although the illustrated valve bore 18 and valve chamber 16 are substantially perpendicular to the bridge 10, valve housings in other embodiments have bores and/or chambers oriented at other angles to allow combustion products to escape from a missile at a variety of angles with respect to the central longitudinal axis of the missile. As noted elsewhere, valve housings may also contain burst disks, throats, venturis, and other means for controlling the flow of gas from a gas generator.

FIG. 1 illustrates a preliminary configuration during the construction of a system according to the present invention. According to the illustrated embodiment, proper alignment of the valve housings 12 relative to the bridge 10 is achieved by alignment tools 24. A rigid arm 26 of each alignment tool 24 extends through a port 28 in the bridge 10 and from there into the valve chamber 16. The tool arm 26 fits snugly against the inner wall of the valve chamber 16, thereby helping to hold the valve housing 12 in an aligned position. Proper alignment of the valve housings 12 provides control over the thrust vectors produced by combustion products exiting the diverter through the housings 12.

A layer of insulation 30 lines the case chamber 20. The insulation 30 also covers at least a portion of the outer surface of each valve housing 12. The insulation 30 comprises a layer of material such as rubber, polyisoprene, rubber mixed with silica, or rubber mixed with the aramid fiber sold under the mark KEVLAR® by E. I. Du Pont de Nemours and Co. In an alternative embodiment, the insulation comprises a layer of composite material of the type used to line gas generators, including without limitation phenolic resins such as silica phenolic and carbon phenolic.

The insulation 30 forms an integral layer to hold the valve housings 12 in their aligned positions and provide a hot gas seal around the valves housings 12. As used herein, two structures are deemed "integral" or "integrally secured" if they are not removable from one another except by cutting, breaking, dissolving, or otherwise destructively creating a boundary which fully separates the two structures. Structures that are secured to one another solely by releasable mechanical means such as bolts, screws, latches, and the like may be unitary but are not integral. Two fibers in a composite material are integrally connected if each fiber is at least partially embedded in the same block of resin. Two portions of cured rubber or rubber-containing material are integral if they were bonded together during curing.

In the embodiment illustrated, the insulation 30 covers substantially the entire outer surface of the valve housing 12, including the outer surface of the valve housing 12 that is nearest the bridge 10. In some alternative embodiments, the insulation 30 substantially covers only the free outer surface of the valve housing. That is, the insulation substantially covers only the portion of the outer surface that helps define the chamber 20, and the insulation is not significantly interposed between the valve housing and the bridge.

In other alternative embodiments, the valve housings comprise materials capable of directly resisting combustion without additional insulation, and the insulation contains at least one opening. In such embodiments the insulation assists in securing the valve housings in position without substantially covering the outer surface of the valve housing.

The bridge 10, one or more valve housings 12, and the insulation 30 together form a valve subassembly 32. At some point during manufacture of the diverter, the valve subassembly 32 is cured and the alignment tools 24 are removed. Curing of the valve subassembly 32 includes at least curing of the insulation 30 and may include curing of the bridge 10. In the cured valve subassembly 32, the valve housings 12 are secured to the bridge 10 by the integral cured insulation 30.

Figure 2:
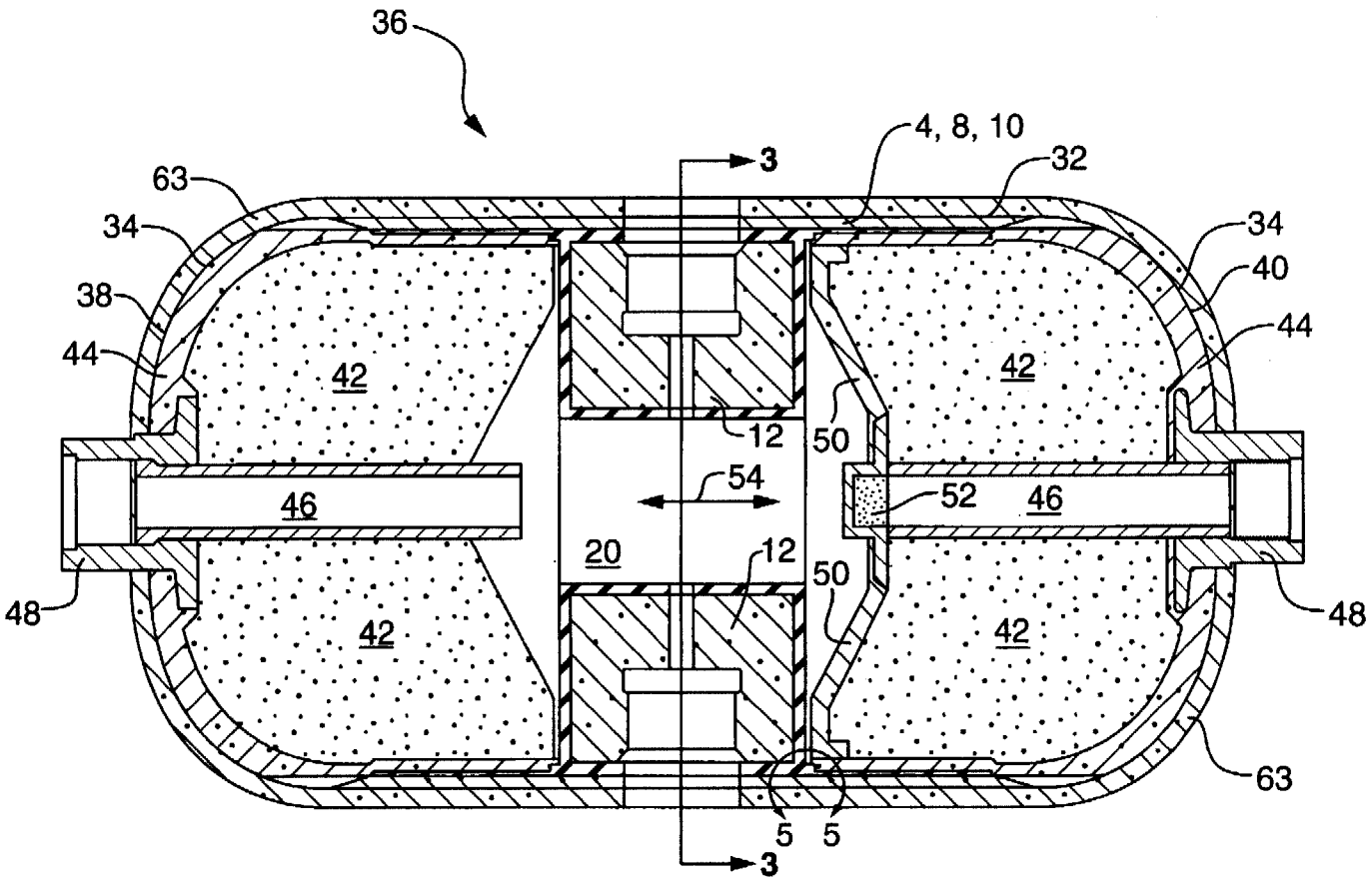
FIG. 2 is a longitudinal cross-section of a gas generator having integrated valve housings and two loaded propellant cups according to the present invention.

FIG. 2 illustrates the configuration of one embodiment of the present invention in which the cured valve subassembly 32 is combined with loaded propellant cups 34 to form a gas generator 36. The propellant cups 34 include a primary cup 38 and a secondary cup 40. The primary cup 38 and the secondary cup 40 each include a solid fuel propellant 42 disposed within a cup-shaped container 44.

The propellant 42 in each cup 34 shown substantially defines a chamber 46. The chamber 46 may be an extension of the combustion chamber 20. In some embodiments, the chamber 46 is used to transfer hot gas to other locations in the gas generator 36, such as additional valves located near or in place of a polar boss 48. Other embodiments contain a solid propellant grain which lacks any central chamber such as the chamber 46. Some embodiments place conventional igniters within the chamber 46, while others simply leave the chamber 46 empty.

Suitable propellants 42 are readily determined by those of skill in the art. The propellant 42 preferably has a flame temperate in the range from about 2000 degrees Fahrenheit to about 5000 degrees Fahrenheit, and most preferably burns at about 3700 degrees Fahrenheit. Solid, liquid, or hybrid propellants may be used.

One suitable group of propellants 42 are "HTPB propellants," each of which includes a hydroxy-terminated polybutadiene (HTPB) binder. Such binders are widely used and commercially available. One example of such an HTPB propellant includes about 79.4 percent by weight ammonium perchlorate (AP) as an oxidizer, about 20.2 percent isophorone diisocyanate (IPDI) as a curative, and about 0.3 percent isophthaloyl-bis(methyl-ethyleneimide), known as HX-752 in the industry, as a bonding agent. HX-752 has the following chemical structure:

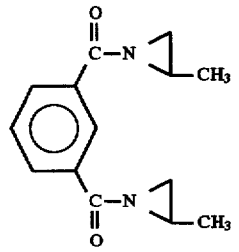

This particular HTPB propellant 42 may also include about 0.1 percent of a conventional coloring agent known in the trade as Thermax. Those of skill in the art will appreciate that the exact amount of each ingredient used in an HTPB embodiment of the propellant 42 which may vary by several percentage points according to the specific intended use of the propellant 42. It will also be appreciated that many other propellant compositions may also be used in the propellant 42, including propellants 42 which do not include HTPB. Any suitable gas generator propellant formulation may be used in connection with the present invention.

In one alternative embodiment, a different propellant composition is used in the primary cup than is used in the secondary cup. In another embodiment, only one propellant cup is present. In some multi-stage embodiments, more than two propellant cups are used. Although the embodiment illustrated shows a solid fuel propellant 42, those of skill in the art will appreciate that the present invention also comprises diverters powered by liquid fuels and diverters powered by a hybrid of solid and liquid propellants.

Each cup 34 includes a polar boss 48. Suitable materials for use in the bosses 48, suitable techniques for forming the bosses 48, and suitable methods for securing each boss 48 to its respective cup 34, are familiar to those of skill in the art. According to one method, the cups 34 are formed by laying up insulation material over a mandrel mounted on a shaft extending between the polar bosses 48, thereby forming an insulation bladder. After the insulation material cures and the shaft is removed, the bladder is cut along a plane transverse to the axis of the shaft, thereby forming the two cup-shaped containers 44. The containers 44 are then loaded with propellant 42 by slurry casting or other familiar techniques.

Figure 6:
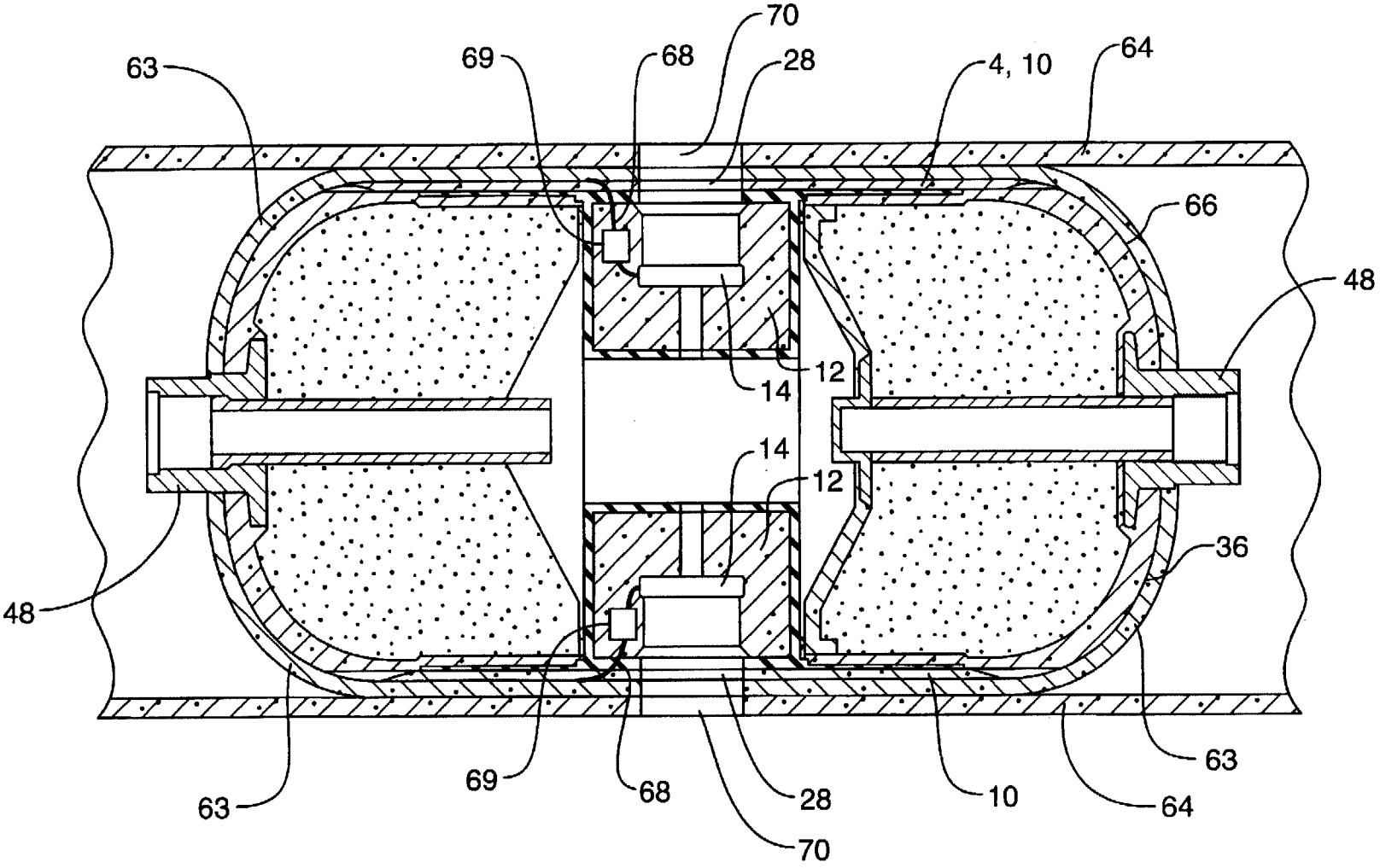
FIG. 6 is a partial longitudinal cross-section of a missile in which the gas generator of FIG. 2 is mounted.

With reference to FIGS. 2 and 6, the loaded cups 38, 40 are then secured to the valve subassembly 32. A gas generator case 63 is then formed over the subassembly 32 by filament winding or other familiar techniques. The ports 28 in the case 63 may be formed during winding or may be machined after the case 63 is formed.

The embodiment shown in FIG. 2 is a two-stage embodiment which includes a removable barrier 50. The barrier 50 separates the first-stage primary cup 38 and the valve housings 12, on the one hand, from the propellant 42 and combustion chamber 46 of the second-stage secondary cup 40, on the other hand.

The barrier 50 substantially retains its structural integrity in response to combustion of the propellant 42 of the primary cup 38. However, the barrier 50 is configured to melt, vaporize, burst, or otherwise allow fluid communication between the combustion chamber 46 of the secondary cup 40 and the valve housings 12. Ignition of the propellant 42 of the secondary cup 40 followed by adequate pressurization of the combustion chamber 46 of the secondary cup 40 will substantially remove the barrier 50. Alternatively, the barrier 50 may be removed by detonation of a small explosive charge 52.

Figure 3:
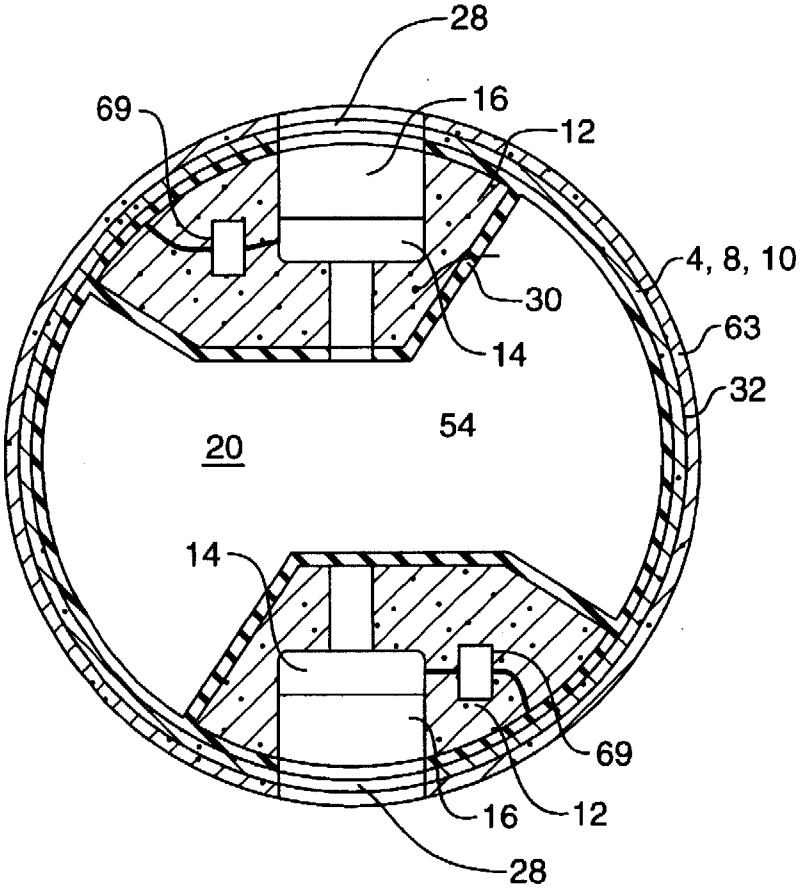
FIG. 3 is a transverse cross-section of the gas generator indicated by line 3—3 in FIG. 2.
Figure 4:
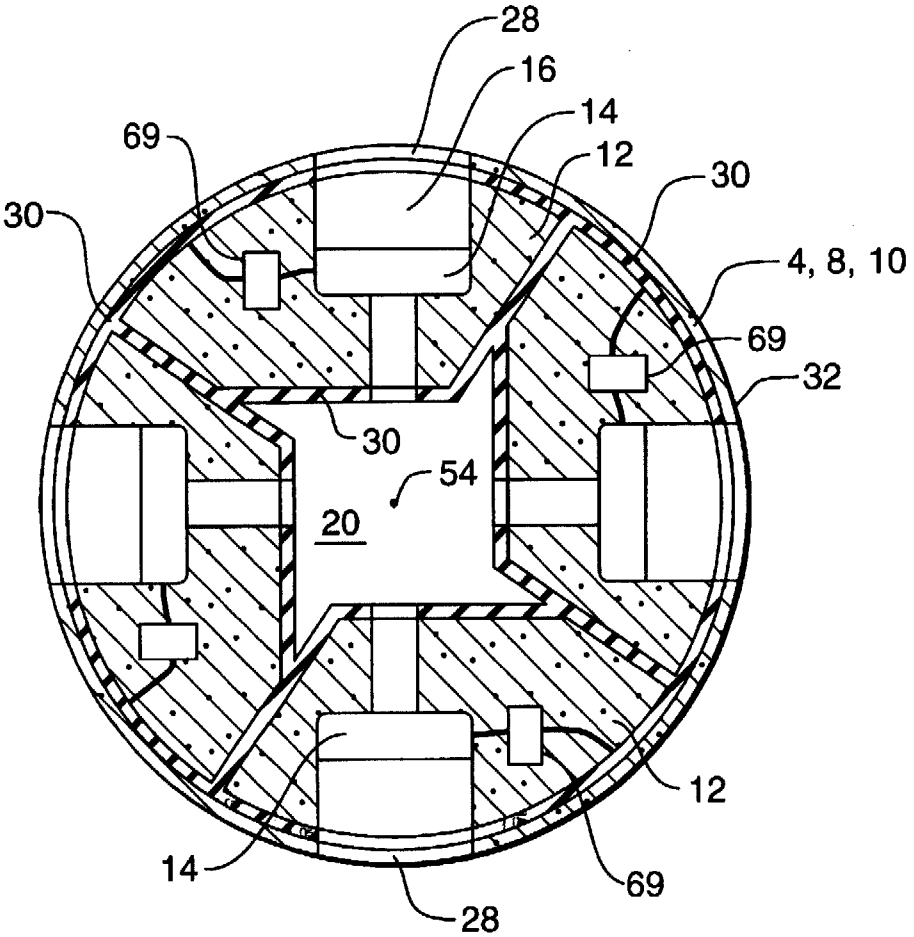
FIG. 4 is an alternative embodiment of the gas generator shown in FIG. 3.

As shown in FIG. 3, one embodiment of the valve subassembly 32 includes two valve housings 12 spaced 180 degrees apart about a central longitudinal axis 54 of the subassembly 32. As shown in FIG. 4, an alternative embodiment includes four valve housings 12 spaced 90 degrees apart. It will be appreciated that other alternative embodiments include one or more valve housings which are spaced evenly, valve housings which are spaced unevenly but symmetrically, or valve housings which are spaced asymmetrically, with respect to the central longitudinal axis 54.

Figure 5:
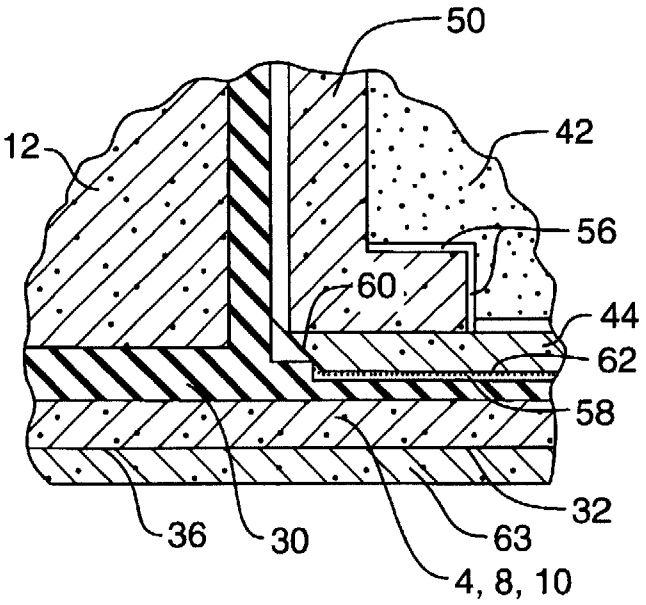
FIG. 5 is an enlarged portion of the gas generator indicated by line 5—5 in FIG. 2.

FIG. 5 illustrates the junction of the barrier 50, the bridge 10, and the insulation 30 in one embodiment of the gas generator 36. As illustrated, the barrier 50 abuts the cup-shaped container 44. A first layer of adhesive 56 connects the barrier 50 to the propellant 42 within the container 44. A second layer of adhesive 58 connects the container 44 to the insulation 30 of the valve subassembly 32. Suitable adhesives include resinous plastic adhesive compositions that are well-known in the art and commercially available.

The cup-shaped container 44 meets the insulation 30 near the valve housing 12 along a beveled edge 60. In the illustrated embodiment, the beveled edge 60 assumes an angle of about 45 degrees relative to an outside surface 62 of the cup-shaped container 44. Other bevel angles are used in alternative embodiments.

FIG. 6 illustrates the gas generator 36 overwrapped by the gas generator case 63 and secured within a missile shell 64 for use as a diverter 66. The gas generator case 63 is formed by fiber winding, tape lay-up, or other means well-known in the art. The gas generator case 63 comprises metal and/or composite materials of the type suitable for use in gas generators or pressure vessels, including materials of the type previously identified as suitable for use in the bridge 10.

The gas generator case 63 is secured to the missile shell 64 by adhesives, mating ridges, or other means readily determined by those of skill in the art. Within the diverter 66, control lines 68 are connected to conventional electronics 69 controlling each of the valves 14 to allow remote actuation of the valves 14 through electrical signals, pneumatic pulses, or other signal means. Alternative embodiments, such as those employing burst disks or throats in the valve housings, omit such control lines. The ports 28 in the diverter 66 are aligned with ports 70 in the missile shell 64.

Figure 7:
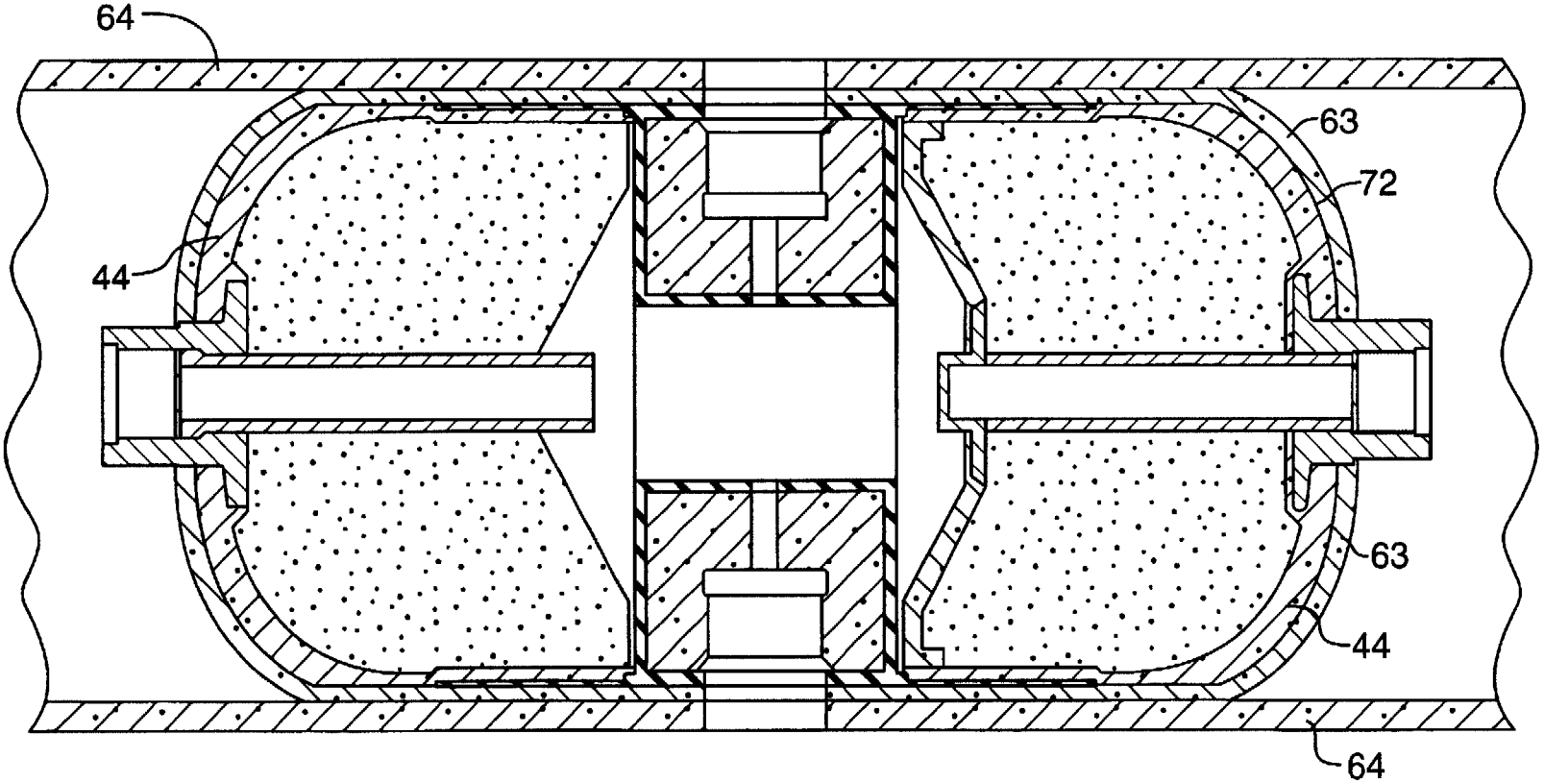
FIG. 7 is a partial longitudinal cross-section of a missile in which an alternative embodiment of a diverter gas generator is mounted.

FIG. 7 illustrates an alternative diverter 72 which lacks the bridge 10 shown in FIG. 6. In this alternative embodiment, the cup-shaped containers 44 are secured directly to the missile shell 64. Omitting the bridge 10 requires corresponding changes in the manufacture of the diverter 72 but also reduces the weight of the diverter 72 in comparison to the diverter 66 of FIG. 6.

In addition to diverters, the present invention includes methods for manufacturing diverters. With reference to FIG. 1, one method includes the step of securing the gas valves 14 within their respective gas valve housings 12. Each of the valve housings 12 is then positioned within the insulation support 4 in a predetermined desired position. According to one method, the support 4 comprises removable tooling 8; according to another, the support 4 comprises a bridge 10.

One method places the valve housings 12 equidistant from one another in a plane perpendicular to the central axis 54 of the support 4 as shown in FIG. 3. One positioning step places four valve housings ninety degrees apart from one another in a plane perpendicular to the central axis 54.

Proper positioning of the valves 14 is assisted by resting the valve housings 12 against the interior wall of the support 4. By contrast, the pipes used in conventional diverters are braced in position between the outside of a gas generator case and the interior of a missile shell. In accordance with the present invention the valve housings 12 may be mechanically attached to the bridge 10 by bolts, interlocking ridges, or other means. Unlike the pipes of conventional diverters, however, the valve housings 12 of the present invention do not rely solely or primarily on mechanical attachments to maintain their proper alignment during flight. Instead, the valve housings 12 are secured by the layer of integral cured insulation 30 which also provides a hot gas seal to prevent combustion products from exiting the chamber 20 except through the valves 14.

To secure the valve housings 12 and create the hot gas seal, a quantity of uncured insulation 30 is applied to the inside surface of the insulation support 4. Another quantity of uncured insulation 30 is applied to the outside surface of each of the diverter gas valve housings 12. The insulation 30 on the support 4 is bonded to the insulation 30 on the valve housings 12 by curing the rubber or other binder in the insulation 30 to create an integral quantity of vulcanized or cured insulation. Proper techniques for vulcanizing rubber insulation and for curing composite insulation are well known by those of skill in the art.

According to one method, the insulation bonding surfaces such as the inside wall of the bridge 10 and the outer surface of each valve housing 12 are prepared for bonding as follows. Each surface is cleaned using a solvent, and then allowed to air dry for at least 15 minutes at a temperature in the range from about 60 to about 90 degrees Fahrenheit. Next, each surface is abraded to remove all gloss, and dry wiped to remove all residue. A primer is then applied to each surface and allowed to air dry for a period ranging from about one-quarter hour to about 24 hours at a temperature in the range from about 60 to about 90 degrees Fahrenheit. An adhesive is then applied to each surface and allowed to air dry for a period ranging from about one-quarter hour to about 24 hours at a temperature in the range from about 60 to about 90 degrees Fahrenheit. Suitable adhesives include resinous plastic adhesive compositions that are well-known in the art and commercially available.

Drying times and temperatures will be readily determined by those of skill in the art according to the materials used. Suitable primers include resinous plastic adhesive primers. One suitable primer is sold under the trade name CHEMLOK® 205; CHEMLOK is a registered trademark of Lord Corporation of Erie, Pa. Suitable adhesives include resinous plastic adhesive compositions. One suitable adhesive is sold under the trade name CHEMLOK® 236A by Lord Corporation. Other suitable solvents, primers, and adhesives are well known by those of skill in the art.

The insulation 30 is applied to the bonding surfaces and then typically cured for a period ranging from about 2.5 to about 3.0 hours at a temperature in the range from about 290 to about 320 degrees Fahrenheit and a pressure in the range from about 75 to about 125 p.s.i.g. The insulation 30 may contain rubber, composites, or other materials. The rubber insulation is expected to flow somewhat during cure. In particular, the insulation 30 is permitted to flow into the chamfer 22 of the valve housing 12.

One suitable insulation 30 comprises ethylene propylene diene monomer (EPDM) rubber. One suitable EPDM rubber is sold under the part number KL-60-269 by Kirkhill Rubber Co. Other suitable insulation compositions, including without limitation other suitable EPDM rubber compositions, are well known by those of skill in the art, as are suitable tools for vulcanization, such as vacuum bags and autoclaves.

With reference to FIG. 2, some methods of the present invention also include the step of loading solid fuel propellant 42 into the gas generator 36 adjacent the valve housings 12. This is accomplished by loading one or more cups 34 which carry the propellant 42. The cups 34 are placed adjacent the valve housings 12 such that combustion products from combustion of the propellant 42 will travel through a selected housing 12 (that is, a housing 12 whose valve 14 is opened) and away from the missile after the propellant 42 is ignited. The cups 34 are bonded to the bridge 10 with an adhesive which is then cured. Suitable adhesives are commercially available. One suitable cure requires at least 16 hours at a temperature in the range from about 60 to about 90 degrees Fahrenheit. Other suitable cures are readily determined by those of skill in the art.

One method also includes placing the removable barrier 50 between one or more of the loaded propellant cups 34 and the valve housings 12. The barrier 50 allows ignition of the propellant 42 in different cups 38, 40 at different times. The barrier 50 is preferably bonded to the loaded cup 40 by suitable adhesive before the cup 40 is bonded to the bridge 10.

With reference to FIG. 6, after the insulation 30 is cured and the cups 34 are bonded to the bridge 10, the entire gas generator assembly 36 is overwrapped by a gas generator case 63 and secured to the missile shell 64 by adhesive or other securing means. Wires or other control lines 68 are connected to the valves 14 and secured to the bridge 10 to support remote actuation of the valves 14 during flight. The control lines 68 may be connected in a manner that allows each gas valve 14 to be actuated independently of the other gas valves 14. Alternatively, the control lines 68 may be configured to actuate two or more selected valves 14 in tandem.

In one embodiment, the control lines 68 comprise wires that are coated with polytetrafluoroethylene or another material which resists bonding to the insulation 30. To prevent the control lines 68 from breaching the hot gas seal that will be created by the layer of integral cured insulation 30, the polytetrafluoroethylene is stripped from around the wires, thereby baring a section of wire at least about one inch long at an accessible location near the valve housing 12. The bare wire is bonded to the insulation 30 by an adhesive such as a resinous plastic adhesive. After being embedded in the uncured insulation 30, the wires are further secured by the subsequent vulcanization of the insulation 30. Sealing the wires to the insulation 30 in this manner assists in maintaining the hot gas seal created by the insulation layer 30.

With reference to FIGS. 2 and 7, one method of the present invention applies the uncured insulation 30 to an inside surface of the removable tooling device 8 rather than applying it to the inside surface of the bridge 10. The valve housings 12 are positioned within the tooling device 8. The insulation 30 is then cured and the tooling device 8 is removed from the cured insulation 30. The cured insulation 30 and the valve housings 12 are then secured within the gas generator case 63.

In summary, the present invention provides a missile diverter having valve housings rather than pipes that direct the flow of combustion products during flight. Unlike the pipes used in conventional diverters, the valve housings of the present invention are reliably aligned. The valve housings rest against the inner wall of the bridge or the missile shell instead of being braced outside a gas generator case. The valve housings are further secured by the integral layer of insulation which bonds the housings to the bridge and provides a hot gas seal around the housings. Eliminating the lengthy, heavy pipes and braces of conventional diverters also makes the present diverter relatively light.

Although particular system embodiments of the present invention are expressly illustrated and described herein, it will be appreciated that additional and alternative system embodiments may be formed according to methods of the present invention. Similarly, although particular method steps of the present invention are expressly described, those of skill in the art may readily determine additional and alternative steps in accordance with the systems of the present invention. Unless otherwise expressly indicated, the description herein of methods of the present invention therefore extends to corresponding systems, and the description of systems of the present invention extends likewise to corresponding methods.

The invention may be embodied in other specific forms without departing from its essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A method for integrating a diverter gas valve housing into a missile, said method comprising of steps of:

applying a quantity of uncured insulation to an inside surface of an insulation support having a central longitudinal axis;

applying another quantity of uncured insulation to an outside surface of the valve housing;

positioning the valve housing within the insulation support; and bonding the quantities of insulation together by curing the quantities of insulation to create an integral quantity of cured insulation to thereby insulate the valve housing.

2. The method of claim 1, wherein said step of applying a quantity of uncured insulation to an inside surface of an insulation support comprises applying a quantity of uncured insulation to an inside surface of an insulation support which is part of a bridge and said positioning step comprises positioning the diverter gas valve housing within the bridge.

3. The method of claim 1, wherein said step of applying a quantity of uncured insulation to an inside surface of an insulation support comprises applying a quantity of uncured insulation to an inside surface of an insulation support which is part of a cylindrical removable tooling device, said positioning step comprising positioning the diverter gas valve housing within the removable tooling device, and said method further comprising the steps of:

removing the removable tooling device from the cured insulation after said bonding step; and securing the cured insulation and the diverter gas valve housing within the missile.

4. A method for integrating a plurality of diverter gas valve housings into a missile, said method comprising of steps of:

applying a quantity of uncured insulation to an inside surface of an insulation support having a central longitudinal axis;

applying another quantity of uncured installation to an outside surface of each diverter gas valve housings;

positioning the diverter gas valve housings within the insulation support; and bonding the quantities of insulation together by curing the quantities of insulation to create an integral quantity of cured insulation to thereby insulate the valve housings.

5. The method of claim 4, wherein said positioning step comprises positioning the plurality of diverter gas valve housings generally equidistant from one another and generally in a plane perpendicular to the central axis of the insulation support.

6. The method of claim 4, wherein the plurality of diverter gas valve housings comprises four diverter gas valve housings, and said positioning step comprises positioning the four diverter gas valve housings substantially ninety degrees apart from one another in a plane perpendicular to the central axis of the insulation support.

7. The method of claim 1, wherein the uncured insulation includes rubber and said bonding step comprises vulcanizing the rubber.

8. The method of claim 1, wherein the uncured insulation includes a composite material.

9. The method of claim 1, further comprising the step of securing a diverter gas valve within the diverter gas valve housing after said bonding step.

10. The method of claim 1, further comprising the step of loading propellant into a bridge adjacent the diverter gas valve housing after said bonding step.

11. A method for integrating a plurality of diverter gas valves into a missile having a substantially cylindrical bridge, the bridge having a central longitudinal axis, said method comprising the steps of:

applying a quantity of uncured insulation to an inside surface of the bridge;

applying another quantity of uncured insulation to an outside surface of each of a plurality of diverter gas valve housings;

positioning each of the diverter gas valve housings within the bridge;

bonding the quantities of insulation together by curing the quantities of insulation to create an integral layer of insulation which connects the inside surface of the bridge to the outside surface of each diverter gas valve housing; and securing a diverter gas valve within each of the diverter gas valve housings.

12. The method of claim 11, wherein the uncured insulation contains rubber and said bonding step comprises curing the rubber in the quantities of insulation to create an integral layer of vulcanized insulation which connects the inside surface of the bridge to the outside surface of each diverter gas valve housing.

13. The method of claim 11, wherein said positioning step comprises positioning the plurality of diverter gas valve housings generally equidistant from one another and generally in a plane perpendicular to the central axis of the bridge.

14. The method of claim 11, wherein the plurality of diverter gas valve housings comprises four diverter gas valve housings, and said positioning step comprises positioning the four diverter gas valve housings substantially ninety degrees apart from one another in a ring about the central axis of the bridge.

15. The method of claim 11, further comprising providing a gas generator adjacent the diverter gas valve housings, and loading solid fuel propellant into the gas generator adjacent the diverter gas valve housings.

16. The method of claim 11, wherein said securing step comprises securing a diverter gas valve within each of the diverter gas valve housings, and said method further comprises connecting to each of the diverter gas valves a control line for remotely actuating the diverter gas valves.

17. The method of claim 16, wherein said connecting step comprises securing a bare section of wire to the insulation to assist in maintaining a hot gas seal created by the insulation.

18. A missile diverter comprising:

a bridge having an inside surface;

a plurality of diverter gas valve housings; and a continuous layer of integral cured insulation securing said housings to said inside surface of said bridge and providing at least a portion of a hot gas seal.

19. The missile diverter of claim 18, wherein said layer of integral cured insulation comprises a layer of integral vulcanized material.

20. The missile diverter of claim 18, wherein said layer of integral cured insulation comprises rubber.

21. The missile diverter of claim 18, wherein said layer of integral cured insulation substantially covers a free outer surface of each of said housings.

22. The missile diverter of claim 18, wherein said layer of integral cured insulation comprises a composite material.

23. The missile diverter of claim 18, wherein said plurality of diverter gas valve housings comprises four diverter gas valve housings.

24. The missile diverter of claim 18, wherein said case comprises a substantially cylindrical case having a central longitudinal axis.

25. The missile diverter of claim 24, wherein said housings are positioned generally equidistant from one another and generally in a plane perpendicular to the central axis of said case.

26. The missile diverter of claim 18, further comprising a diverter gas valve secured within each of said housings.

27. The missile diverter of claim 18, further comprising a cup loaded with propellant, said cup secured within said case adjacent said housings.

28. The missile diverter of claim 27, further comprising a second cup loaded with propellant, said second cup also secured within said case adjacent said housings.

29. The missile diverter of claim 28, further comprising a barrier separating said second cup loaded with propellant from said housings.

30. A missile diverter comprising:

a substantially cylindrical bridge having an inside surface and a central longitudinal axis;

a plurality of diverter gas valve housings positioned generally equidistant from one another and positioned generally in a plane perpendicular to the central longitudinal axis of said substantially cylindrical bridge;

a plurality of diverter gas valves, each of said valves being secured within a respective one of said housings; and a continuous layer of integral cured insulation securing said housings to said inside surface of said substantially cylindrical bridge and providing at least a portion of a hot gas seal.

31. The missile diverter of claim 30, wherein said layer of integral cured insulation comprises a layer of integral vulcanized material.

32. The missile diverter of claim 30, wherein said layer of integral cured insulation comprises rubber.

33. The missile diverter of claim 30, further comprising a control line connected to at least one of said gas valves, said control line comprising a bare wire bonded to and secured within said layer of integral cured insulation.

34. The missile diverter of claim 30, wherein said layer of integral cured insulation substantially covers a free outer surface of each of said housings.

35. The missile diverter of claim 30, wherein said layer of integral cured insulation comprises a composite material.

36. The missile diverter of claim 30, wherein said plurality of diverter gas valve housings comprises four diverter gas valve housings.

37. The missile diverter of claim 30, further comprising a cup loaded with propellant, said cup secured within said case adjacent said housings.

38. The missile diverter of claim 37, further comprising a second cup loaded with propellant, said second cup also secured within said case adjacent said housings.

39. The missile diverter of claim 38, further comprising a barrier separating said second cup loaded with propellant from said housings.

* * * * *